United States Patent [19]

Starbard

[11] 4,025,224

[45] May 24, 1977

[54] MULTIPLE AIR MOTOR DRIVE UNIT

[76] Inventor: Raymond E. Starbard, 190 Hoffman Ave., Auburn, Calif. 95603

[22] Filed: Dec. 2, 1975

[21] Appl. No.: 637,064

[52] U.S. Cl. ..... 415/60; 415/122 R; 415/145; 415/61

[51] Int. Cl.[2] ..... F01D 13/00

[58] Field of Search ..... 415/60, 61, 62, 145, 415/122

[56] References Cited

UNITED STATES PATENTS

| | | | |
|---|---|---|---|
| 608,969 | 8/1898 | Parsons | 415/61 |
| 897,540 | 9/1908 | Kieser | 415/145 |
| 1,011,826 | 12/1911 | London | 415/145 |
| 1,269,404 | 6/1918 | Dickinson | 415/61 |
| 1,287,603 | 12/1918 | Newton | 415/61 |
| 1,294,437 | 2/1919 | Flanders | 415/61 |
| 1,946,182 | 2/1934 | Thompson | 415/145 |
| 2,112,090 | 3/1938 | Hanschke | 415/61 |
| 3,001,692 | 9/1961 | Schierl | 415/60 |

*Primary Examiner*—Henry F. Raduazo
*Attorney, Agent, or Firm*—Blair & Brown

[57] ABSTRACT

A multiple air motor drive unit in which the motors are mounted in series to permit the exhaust air from the first motor to be used in driving the second motor. The exhaust air from the second motor assists in driving the third motor. The exhaust air from the third motor assists in driving the fourth motor. A line extending from the intake side of the first motor provides additional air pressure to the intake side of each of the succeeding motors so that each motor is operating under the same operating pressure. The motors are geared to gears on a common shaft which extends through a universal joint to the apparatus to be driven.

The unit may be used to help power a motor vehicle if desired.

1 Claim, 5 Drawing Figures

MULTIPLE AIR MOTOR DRIVE UNIT

BACKGROUND OF THE INVENTION

FIELD OF THE INVENTION

The present invention relates to a multiple air motor drive unit.

SUMMARY OF THE INVENTION

The multiple air motor drive unit of the present invention includes a plurality of air motors geared to a common shaft and interconnected serially so that the exhaust air from one motor assists in driving the next motor of the group. A line provides pressure to the intake side of each motor sufficient to equalize the air pressures actuating the successive motors.

The primary object of the invention is to provide a multiple air motor drive unit which utilizes the exhaust air from one motor to assist in driving the next motor of the unit.

Other objects and advantages will become apparent in the following specification when considered in light of the attached drawings.

DESCRIPTION OF THE PREFERRED EMBODIMENT

Figure 1:
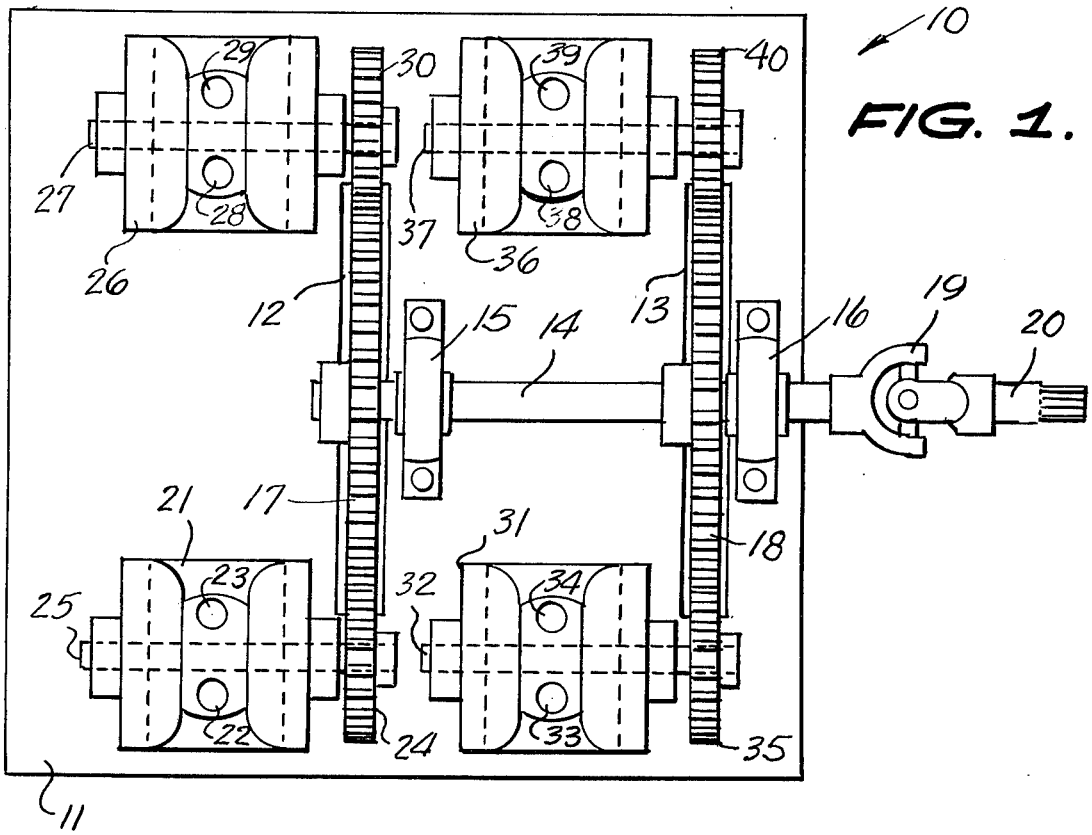
FIG. 1 is a top plan view of the invention.

Referring now to the drawings in detail wherein like reference characters indicate like parts throughout the several figures, the reference numeral 10 indicates generally a multiple air motor drive unit constructed in accordance with the invention.

Figure 2:
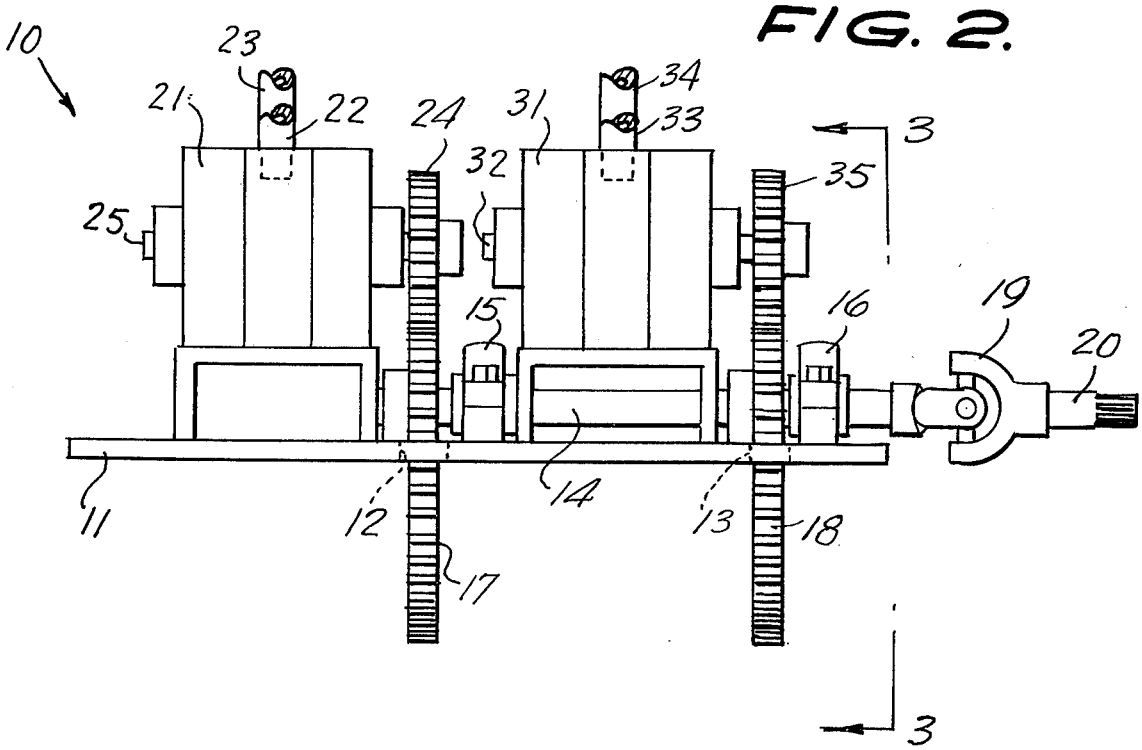
FIG. 2 is a side elevation of the invention.
Figure 3:
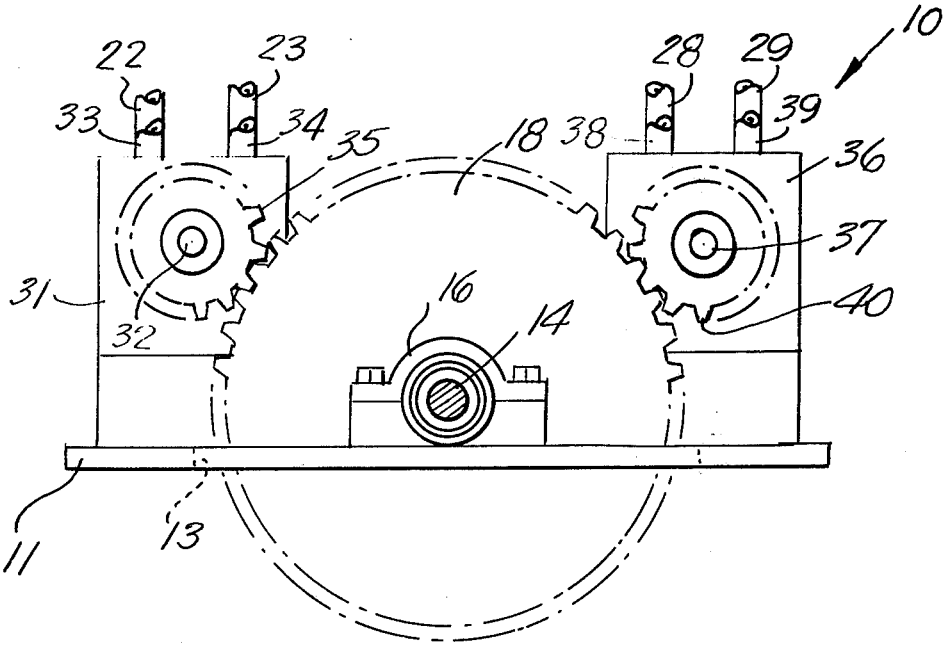
FIG. 3 is a transverse cross section taken on the line 3—3 of FIG. 2 looking in the direction of the arrows.
Figure 4:
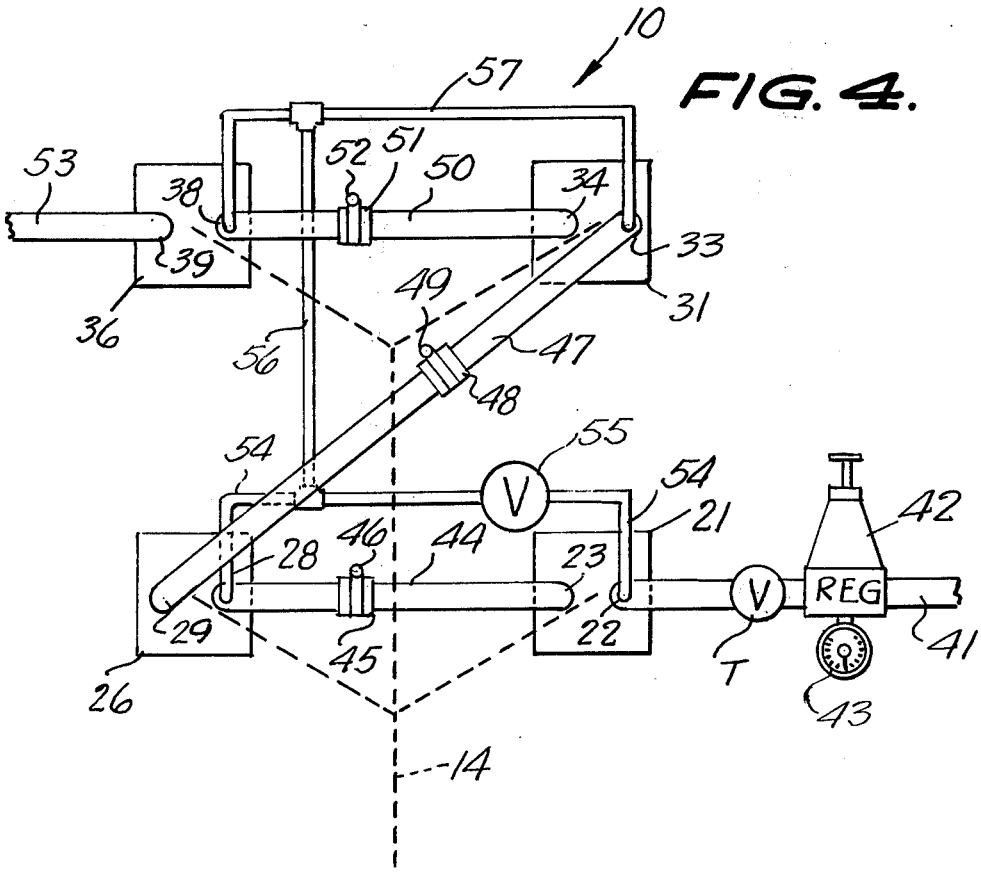
FIG. 4 is a semi-diagrammatic top plan view of the invention illustrating the connection of the air conduits.
Figure 5:
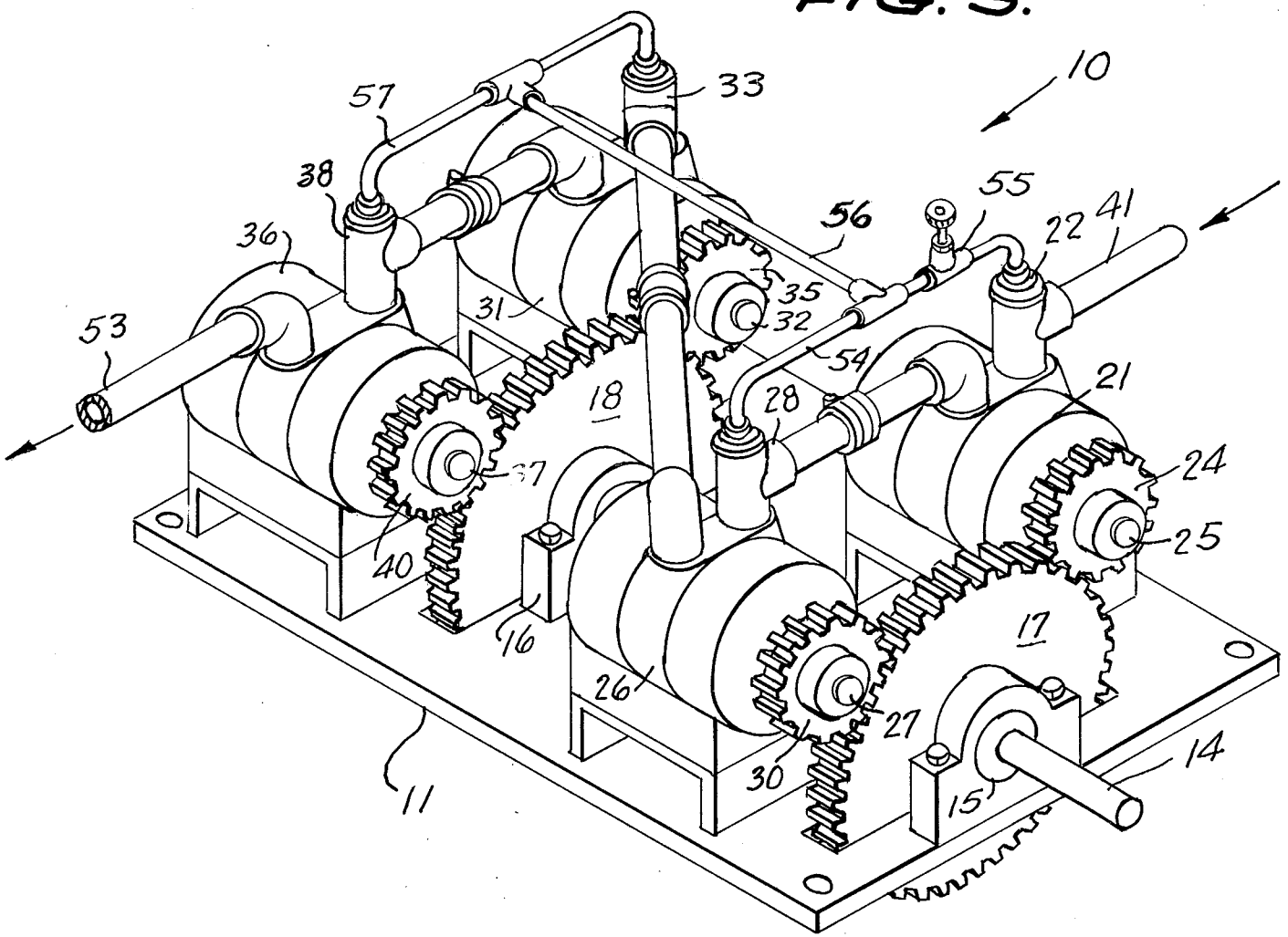
FIG. 5 is a perspective view of the invention.

The unit 10 includes a generally horizontal base plate 11 having a pair of spaced apart parallel generally rectangular openings 12, 13 formed therein as can be clearly seen in FIGS. 1 and 2. A shaft 14 is mounted centrally on the base plate 11 in a pair of bearing blocks 15, 16 which journal the shaft 14 for free rotation therein.

A relatively large spur gear 17 is rigidly secured to the shaft at one end thereof and extends downwardly through the opening 12. A second spur gear 18 is secured to the shaft 14 between the bearing blocks 15, 16 and extends down through the opening 13 as can be seen in FIGS. 1 and 2. A universal joint 19 is secured to the end of the shaft 14 opposite the gear 17 and has a stub shaft 20 extending outwardly therefrom to connect the unit 10 to the apparatus to be driven.

A rotary air motor 21 is secured to the base plate 11 and is provided with an inlet fitting 22 and an outlet fitting 23. The air motor 21 has a spur gear 24 mounted on the shaft 25 and meshing with the gear 17 so that rotation of the air motor 21 will rotate the gear 17.

A second air motor 26 is mounted on the base plate 11 with its shaft 27 arranged parallel to the shaft 25. The air motor 26 has an inlet fitting 28 and an outlet fitting 29 and the shaft 27 has a spur gear 30 mounted thereon and meshing with the gear 17.

A third air motor 31 has a shaft 32 and is mounted on the base plate 11 with the shaft 32 in axial alignment with the shaft 25. The air motor 31 has an inlet fitting 33 and an outlet fitting 34. A spur gear 35 is mounted on the shaft 32 and meshes with the gear 18 on the shaft 14.

A fourth air motor 36 has a shaft 37 in axial alignment with the shaft 27 and is mounted on the base plate 11. The air motor 36 has an inlet fitting 38 and an outlet fitting 39 as can be seen in FIG. 1. A spur gear 40 is mounted on the shaft 37 and meshes with the gear 18 as can be seen in FIG. 1. The air motor 21, 26, 31 and 36 are geared together and all operate simultaneously to drive the shaft 14 through the gears 17, 18.

An air supply conduit 41 extends from a source of air under pressure and includes an air pressure regulator 42 coupled with a pressure gauge 43. The conduit 41 is connected to the inlet fitting 22 of the motor 21. A conduit 44 is connected to the outlet fitting 23 of the motor 21 at one end and at the opposite end to the inlet fitting 28 of the motor 26. A sealing joint 45 including a circumferential clamp 46 is positioned in the conduit 44 to permit ease to assembly and disassembly of the unit.

A conduit 47 extends from the outlet fitting 29 of the motor 26 to the inlet fitting 33 of the motor 31. A sealing joint 48 including a clamp 49 is positioned in the conduit 47 to permit ease of assembly and disassembly of the unit 10.

A conduit 50 extends from the outlet fitting 34 of the motor 31 to the inlet fitting 38 of the motor 36 and includes a sealing connector 51 having a clamp 52 forming a part thereof. An exhaust pipe 53 extends from the outlet fitting 39 on the motor 36 to exhaust the air therefrom to the atmosphere.

A line 54 extends from the inlet fitting 22 of the motor 21 to the outlet fitting 28 of the motor 26 through a valve 55. The line 54 extending directly into the fitting 28 on top of the motor 26 provides sufficient air to replace the pressure drop in the motor 21 so as to provide the motor 26 with air at the same pressure as was provided to the motor 21. A line 56 extends from the line 54 to a line 57. The line 57 is connected to the inlet fitting 33 of the motor 31 at one end and at its opposite end to the inlet fitting 38 of the motor 36. The motors 31, 36 are provided with air through the lines 54, 56, 57 to replace that lost in the pressure drop in operating the motors 26 and 31.

A throttle valve T is positioned between the regulator 42 and the intake fitting 22 of the motor 21 so that the supply of air, and thus the speed of the unit 10 can be controlled from a remote position.

The valve 55 governs the flow of air in the line 54 supplying motor 26 with auxiliary air and motors 31 and 36 through lines 56, 57. When starting the unit 10 it may be found that one or more of the multiple motors are operating unsatisfactorily and adjustments on the valve 55 will produce uniform operation of the unit 10.

Having thus described the preferred embodiment of the invention it should be understood that numerous structural modifications and adaptations may be resorted to without departing from the spirit of the invention.

What is claimed is:

1. An air motor power unit comprising a base, a plurality of air motors secured to the base, each of said air motors having an air inlet fitting and an air exhaust fitting, a shaft in each of said air motors driven thereby, gear means connecting said motor shafts to a common drive shaft including a spur gear on the shaft of each of said air motors, a central shaft extending parallel to the shafts of each of said air motors, and spur gear means on said central shaft meshing with the gears on the shaft of each of said air motors, conduit means connecting the exhaust fitting of one of said air motors to the inlet fitting of the next succeeding air motor interconnecting all of said air motors, means to balance the air pressure on the inlet side of each of said air motors comprising a conduit interconnecting the inlet fittings of all of said air motors, said conduit being substantially smaller in diameter than said conduit means, a control valve in said conduit for controlling the flow of air therethrough, a pressure regulator controlling the air pressure reaching the inlet fitting of the first of said air motors, and a throttle valve between said pressure regulator and the first of said air motors.

* * * * *